US007654682B2

(12) United States Patent
Denham

(10) Patent No.: US 7,654,682 B2
(45) Date of Patent: Feb. 2, 2010

(54) GLOVE SUPPORTING A POM POM AT A FINGER TIP

(76) Inventor: Teresa E. Denham, 107 72nd St., Virginia Beach, VA (US) 23451

( * ) Notice: Subject to any disclaimer, the term of this patent is extended or adjusted under 35 U.S.C. 154(b) by 212 days.

(21) Appl. No.: 12/002,102

(22) Filed: Dec. 14, 2007

(65) Prior Publication Data

US 2009/0154142 A1 Jun. 18, 2009

(51) Int. Cl.
*F21V 21/08* (2006.01)
*A41D 19/00* (2006.01)

(52) U.S. Cl. ..... 362/103; 362/800; 2/160

(58) Field of Classification Search ..... 362/103, 362/570, 157, 800, 806; 2/159, 160, 161.1, 2/163, 167, 169; 446/26, 327, 328, 390
See application file for complete search history.

(56) References Cited

U.S. PATENT DOCUMENTS 2,852,885 A * 9/1958 Mayer ..... 446/327
4,369,215 A 1/1983 Offen et al.
5,079,046 A 1/1992 Kessler
5,234,725 A 8/1993 Smith
D365,896 S 1/1996 Zuege
5,962,086 A 10/1999 Offen
D455,528 S 4/2002 Mauldin
6,447,464 B1 9/2002 Dunlevy et al.
6,592,235 B1 * 7/2003 Mayo ..... 362/103
7,251,838 B1 * 8/2007 Rumbaugh et al. ..... 2/160
2005/0208870 A1 * 9/2005 Collard et al. ..... 446/327

FOREIGN PATENT DOCUMENTS

WO WO9621498 7/1996

* cited by examiner

*Primary Examiner*—Bao Q Truong
(74) *Attorney, Agent, or Firm*—David L. Banner

(57) ABSTRACT

A glove having a pom pom freely attached to a tip of one or more of the glove fingers. The glove may bear indicia, for example, a team logo. The pom poms are typically multicolored, consisting of strands of the team, school, or organization colors. The gloves provide warmth to the wearer's hands. In addition, the wearer's hands are free to hold other items, for example, beverage containers, cameras, programs, etc. Selective movement of a wearer's fingers and/or thumb causes a respective pom pom to move in response thereto. Patterns of successive finger/thumb movements may be executed to cause a variety of visual effects from the pom pom-bearing glove. Bells and/or light sources may also be attached to the gloves instead of or in addition to the pom poms. A motion sensitive switch and/or a simple sequencer may be used to create predetermined or random light patterns.

15 Claims, 4 Drawing Sheets

GLOVE SUPPORTING A POM POM AT A FINGER TIP

FIELD OF THE INVENTION

The invention pertains to pom poms and, more particularly, to a glove supporting a pom pom attached to the tip of one or more fingers thereof.

BACKGROUND OF THE INVENTION

Fans of athletic teams often enjoy showing their support by wearing clothing in their favorite teams' colors or bearing team-identifying indicia. When attending competitions, displays of encouragement and/or approval may be shown by displaying banners, placards, or by wearing exaggerated appendages such as large hands having a pointed finger or other such devices.

Additionally, holidays, organizations, and fundraising appeals generally have recognizable associated colors. For example, celebrants usually display red and green for Christmas, and orange for Halloween. As a further example, the color pink is associated with breast cancer awareness.

Fans and cheerleaders alike have embraced the use of pom poms for creating artistic display. Pom poms, also known as pompons, are typically ball-shaped clusters of ribbons or streamers, typically affixed to a handle to allow waving the pom pom in the air. A typical example of such a device is disclosed in U.S. Pat. No. 5,079,046 for POMPON, issued Jan. 7, 1992 to Brian D. Kessler.

Pom poms are widely used by cheerleaders in elaborate displays designed to foster team spirit among the fans. Fans also widely use pom poms to display encouragement to the athletic team from the stands. Pom poms of the prior art typically have occupied the use of the user's hand, requiring that the user set down the pom pom to grasp, for example, a beverage container, camera, or other item. In crowded bleachers, this often results in the loss of or damage to the pom pom.

DISCUSSION OF THE RELATED ART

Several attempts to overcome the shortcomings of such handheld pom poms are found in the prior art. For example, U.S. Pat. No. 4,369,215 for FINGER HELD POMPON, issued Jan. 18, 1983 to Matt D. Offen et al., discloses a pompon that may be slid over the thumb of a wearer. The OFFEN et al. device has a body portion upon which indicia may be displayed providing a receptacle into which the wearer's thumb or finger is inserted and retained. Movement of the wearer's finger then provides motion to the streamers attached to the body.

U.S. Pat. No. 5,234,725 for WRIST POMPON STRUCTURE, issued Aug. 10, 1993 to Catherine L. Smith, teaches an elastomeric, tubular sleeve for placement on the wrist of a wearer. Streamers are attached to the proximal end of the sleeve.

U.S. Pat. No. 5,962,086 for POMPON PET, issued Oct. 5, 1999 to James Offen, discloses a pompon structure having a pair of eyes retained on the finger of a wearer.

U.S. Pat. No. 6,447,464 for THERAPY DEVICE FOR UPPER EXTREMITY DYSFUNCTION, issued Sep. 10, 2002 to Mindy Dunlevy et al., teaches a glove having fastener strips attached near the ends of one or more fingers of a glove.

U.S. Design Pat. No. D365,896 for DUSTING GLOVE, issued Jan. 2, 1996 to Steven J. Zuegue, shows a dusting glove having clusters of fibers disposed at the fingertips of a glove structure.

U.S. Design Pat. No. D455,528 for GLOVE FOR PLAYING WITH A CAT, issued Apr. 9, 2002 to William David Mauldin, teaches a glove having elongated fingers with a cat toy attached to the ends thereof.

Published Patent Application No. WO9621498 for MULTIPLE MARIONETTE CONFIGURED LIKE A GLOVE, published Jul. 18, 1996 upon application by Fenech et al., shows small marionettes disposed at the ends of a glove structure.

Pom rings are available from www.spiritline.com as Catalog No. SL3063A. Small pom poms are attached to rings for retaining the pom pom on a finger.

None of the patents, applications, or device taken singly, or in any combination are seen to teach or suggest the novel glove-attached pom pom arrangement of the present invention.

SUMMARY OF THE INVENTION

In accordance with the present invention, there is provided a glove having a pom pom freely attached to a tip of one or more of the glove fingers. The glove may bear indicia, for example, a logo displayed in appropriate team, group, or holiday colors. Indicia may, of course, include an appropriate holiday symbol, an organization logo, a logo associated with a cause or event, etc. The pom poms may be one color or multicolored. Typically, pom poms are multi-colored, consisting of strands of the team or school colors.

The gloves of the present invention serve other purposes in addition to providing a unique way to enhance celebration of a holiday or to demonstrate association with an organization or a cause. The gloves provide warmth to the wearer's hands during events held in cool or cold weather. Also, the wearer's hands are fee to hold other items, for example, beverage containers, cameras, programs, etc.

It is, therefore, an object of the invention to provide a glove having a pom pom attached at the tip of at least one finger thereof.

It is another object of the invention to provide a glove having indicia provided on at least one major surface thereof.

It is an additional object of the invention to provide a glove having a pom pom displaying the color or colors of an athletic team, school, group, cause, or holiday being supported or celebrated.

It is a further object of the invention to provide a glove having pom poms attached at the tips of multiple fingers so that independent movement of the fingers of a wearer's hand can selectively move each of the respective pom poms.

It is a still further object of the invention to provide a glove having lights and/or bells in addition to pom poms attached at the tips of one or more fingers or the thumb.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a glove having a pom pom attached at the tip of one or more fingers or the thumb thereof.

Figure 1:
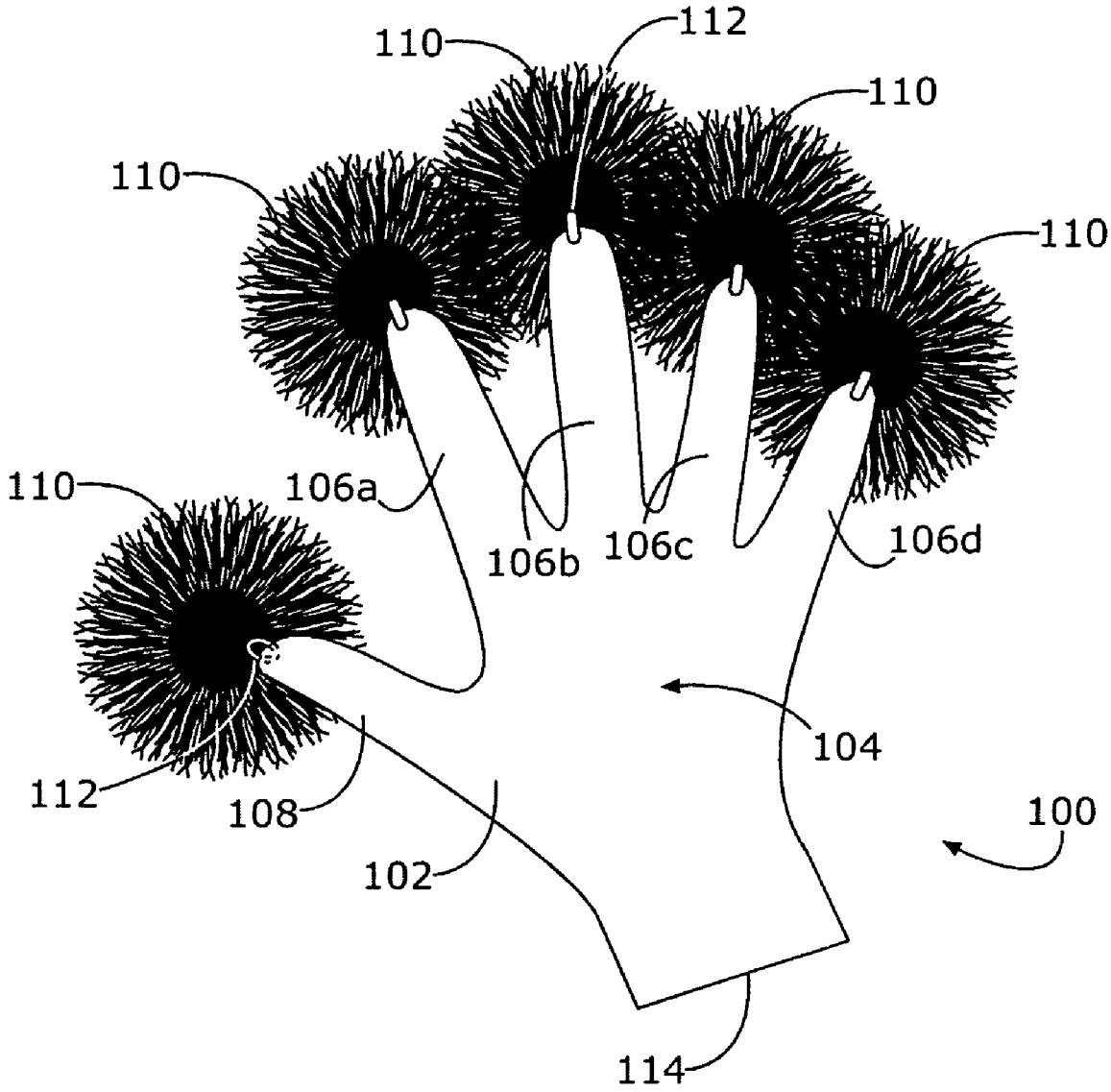
FIG. 1 is a top plan view of a glove in accordance with the invention and having a pom pom attached to each finger and the thumb thereof.
Figure 2:
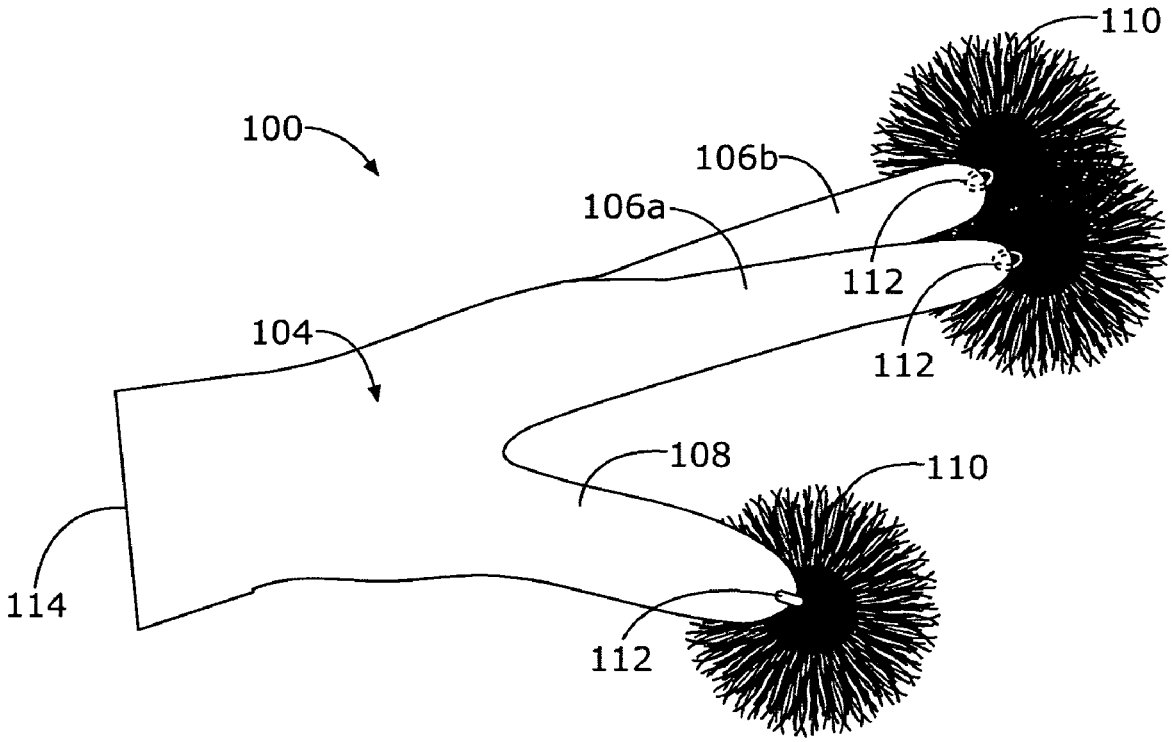
FIG. 2 is a side, elevational view of one of the gloves of FIG. 1.

Referring to FIGS. 1 and 2, there are shown a top plan and a side elevational view, respectively, of a glove in accordance with the present invention, generally at reference number 100. Glove 100 is a standard glove formed from any suitable material. In alternate embodiments of the invention, a mitten or other similar hand covering could be substituted for a glove. For simplicity, the term, "glove" is used herein to refer to any glove, mitten, or similar hand covering apparel, and the invention is not limited to any particular hand covering apparel.

Glove 100 has a body 102 having a proximal end open to receive a hand, not shown, of a wearer, not shown, in a conventional manner. Body 102 has a central region 104, particularly on a back, outward-facing (i.e., opposed to the palm) surface upon which suitable indicia may be placed when desired. Such indicia may include, but is not limited to, a school or team logo, a corporate logo, advertising, holiday symbol, organization or event logo, or any other indicia. Typically, indicia will include school or team colors.

Indicia may be applied to an outer surface of body 102 of glove 100 using any known method or material. Indicia may be painted or printed on body 102 of glove 100. In other embodiments, indicia may be an appliqué applied to glove 100. If glove 100 is knitted, the indicia may actually be knitted into the fabric from which glove 100 is formed. It will be recognized that indicia is optional and that any optional indicia may be placed on glove 100 in areas other than central region 104. Consequently, the invention is not limited to having indicia only on region 104, as shown for purposes of disclosure. Rather the invention comprehends indicia placed anywhere on glove 100.

Finger regions 106*a*, 106*b*, 106*c*, and 106*d* and a thumb 108, extend outwardly from body 102. A pom pom 110 is shown attached to glove 100 at attachment points 112 disposed at the distal ends of finger regions 102*a* . . . 102*d* and thumb 108. More than one pom pom can be attached to a particular finger or thumb region, and consequently, the invention is not limited to a single pom pom on each finger region and thumb region.

Pom poms 110 are attached to glove 100 at attachment points 112 using any suitable means. In the embodiment chosen for purposes of disclosure, a single loop of yarn has been used. This allows maximum amount of movement of pom poms 110 relative to fingers of a wearer, not shown, inserted into finger regions 106*a* . . . 106*d* and thumb 108 of glove 100. It will be recognized by those of skill in the art that numerous other methods and/or materials may be selected for attaching pom poms 110 to glove 100 at attachment points 112. The particular attachment means forms no part of the present invention. Consequently, any suitable method or material may be used in addition to the attachment method used for purposes of disclosure.

While five pom poms have been shown for purposes of disclosure, it will be recognized that fewer or more than five pom poms may alternatively be attached to glove 100.

Pom poms 110 are each typically provided in two or more colors representing a particular school or team. Alternatively, however, pom poms may be a single color.

Figure 3:
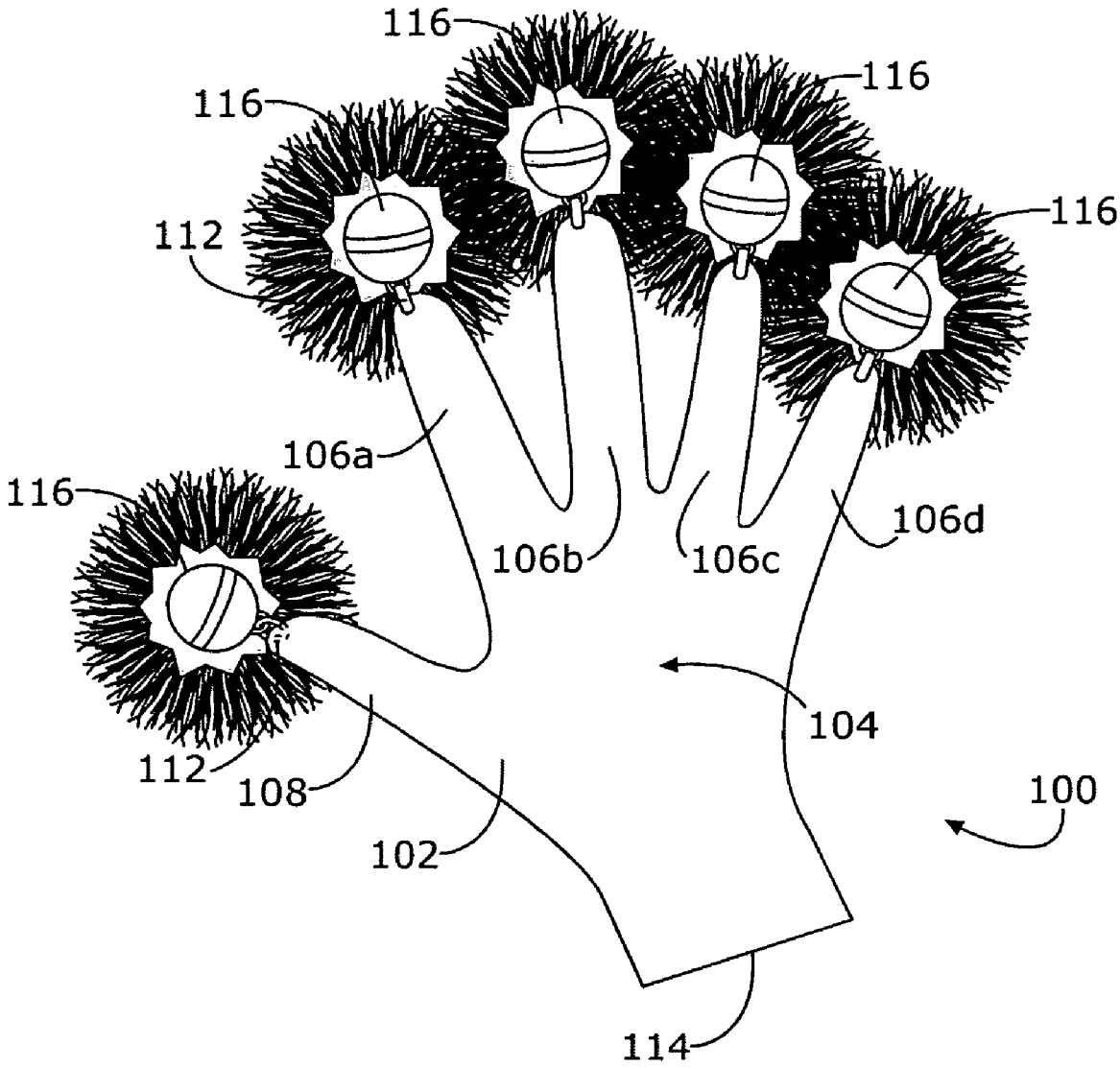
FIG. 3 is a top plan view of a first alternate embodiment of the glove of FIG. 1.

Referring now to FIG. 3, there is shown a top plan view of an alternate embodiment of the glove of the present invention. In addition to pom poms 110, bells 116 are attached to fingers 106*a* . . . 106*d* and/or thumb 108, typically at attachment points 112. Small "sleigh" bells 116 having attachment loops are well known to those of skill in the art and may readily be attached to glove 102 using any suitable technique. Bells may be placed on one or more of fingers 106*a* . . . 106*d* and thumb 108. It will be recognized that while a single bell 116 is shown for purposes of disclosure, multiple bells may be placed on one or more of fingers 106*a* . . . 106*d* and/or thumb 108. In still other arrangements, one or more bells 116 may be disposed on portions of glove 100 other than, or in addition to, fingers 106*a* . . . 106*d* and/or thumb 108. The bells 116 may, of course, be attached to pom poms 110 as well as to fingers 106*a* . . . 106*d* or thumb 108 of glove 100. The bells 116 add a sound component to the visual display provided by pom poms 110 attached to glove 100. While a "sleigh" style bell is shown for purposes of disclosure, it will be recognized that any suitable style bell or other small noise making device may readily be substituted therefor. Consequently, the invention is not limited to the bell chosen for purposes of disclosure. Rather the invention includes any small bell, rattle, or other noise producing apparatus. As used herein, the term, "bell," is intended to include such diverse noise producing devices.

Figure 4:
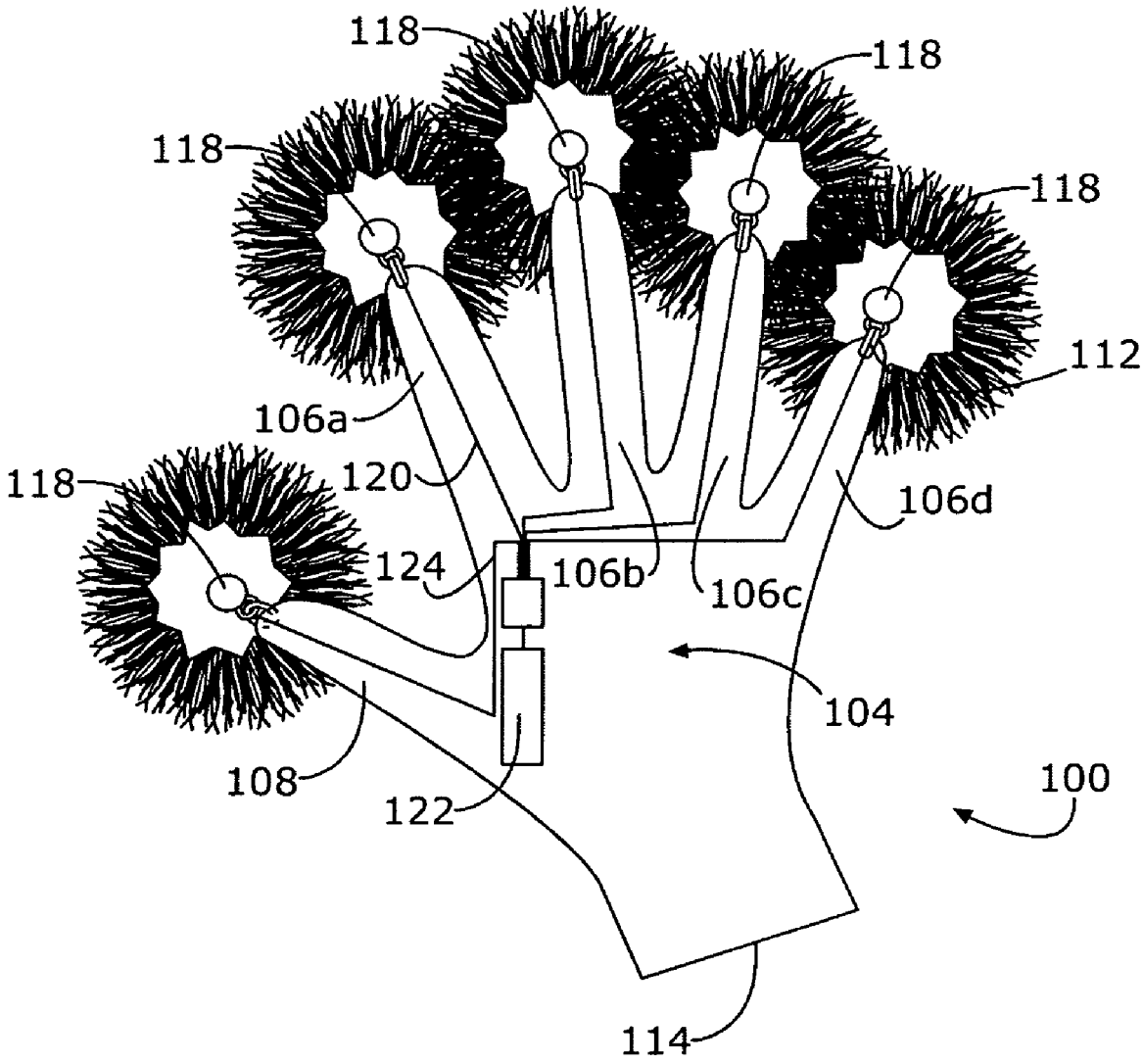
FIG. 4 is a top plan view of a second alternate embodiment of the glove of FIG. 1.

Referring now to FIG. 4, there is shown a top plan view of yet another embodiment of the glove of the present invention. In the embodiment of FIG. 4, small lights 118, such as LEDs, are placed at the tips of fingers 106*a* . . . 106*d* and/or thumb 108 in addition to pom poms 110. Light sources 118 may be placed on a single one of fingers 106*a* . . . 106*d* or thumb 108, on all of fingers 106*a* . . . 106*d* and/or thumb 108, or any other region of glove 100. Thin, flexible wiring, 120 may readily be attached to or woven into glove 102. A battery, shown schematically at reference number 122, may be attached to glove 100 at any convenient location. A switch 124 is interposed between battery 122 and LED 118. Many options exist for implementing switch 124. A movement-sensitive switch may be used to automatically illuminate lights sources 118 upon movement of glove 100. A simple sequencer or flasher, not shown, may be used as a replacement for, or in addition to switch 124 to create predetermined or random patterns of illumination of light sources 118.

In still other arrangements, one or more light sources 118 may be disposed on portions of glove 100 other than, or in addition to, fingers 106*a* . . . 106*d* and/or thumb 108.

It will be recognized that light sources other than LEDs may be used to implement light sources 118. Light sources 118 may be clear or colored, and may be a single color or multiple colors. One or more colors of light sources 118 may be included. The color(s) of light sources 118 may be the same as, complementary to, or completely distinct from the color(s) of pom poms 110.

Light sources 118 may, of course, be attached to pom poms 110 as well as to fingers 106*a* . . . 106*d* or thumb 108 of glove 100.

It will also be recognized that any combination of bells 116 (FIG. 3) and/or light sources 118 may be intermixed.

In use, one or more gloves 100 are donned by a wearer, not shown. The movement of the wearer's fingers cause respective pom poms 110 to move responsively thereto. By independently moving his or her fingers in a particular sequence, various patterns of movement of pom poms 110 may be created. When included, bells 116 and/or light sources 118 may be activated by the wearer of glove 100 to provide audible augmentation and/or additional visual augmentation to the display provided by pom poms 110.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A glove comprising:

a) a glove portion having a proximal, open end for receiving the hand of a wearer, finger regions and a thumb region for respectively receiving fingers and a thumb of said wearer, each of said finger regions and said thumb region having a distal end; and b) at least one pom pom attached to at least one of said finger regions and said thumb region proximate said distal end;

whereby movement of a finger or thumb of said wearer causes a respective one of said at least one pom pom to move responsively thereto.

2. The glove as recited in claim 1, wherein said pom pom comprises a color associated with a school or team.

3. The glove as recited in claim 1, further comprising:

c) indicia disposed on an outside surface of said glove.

4. The glove as recited in claim 3, wherein said indicia comprises at least one selected from the group: a school emblem, a team logo, a corporate logo, a holiday symbol, an organization logo, an event logo, and an advertisement.

5. The glove as recited in claim 3, wherein said indicia comprises at least one color associated with one of the group: a school, team, holiday, organization, cause, and event.

6. The glove as recited in claim 1, wherein said at least one pom pom is attached to said distal end of said at least one of said finger regions and said thumb regions with a single strand of filament.

7. The glove as recited in claim 6, wherein said filament comprises yarn.

8. The glove as recited in claim 1, further comprising:

c) at least one bell attached to at least one of said finger regions and said thumb region proximate said distal end;

whereby movement of a finger or thumb of said wearer causes a respective one of said at least one pom pom to move and said at least one bell to sound responsively thereto.

9. The glove as recited in claim 1, further comprising:

c) at least one light source attached to at least one of said finger regions and said thumb region proximate said distal end.

10. The glove as recited in claim 9, further comprising:

d) a battery operatively connected to said at least one light source; and e) a switch disposed between said battery and said at least one light source.

11. The glove as recited in claim 10, wherein said switch comprises at least one device selected from the group: a simple power switch, a motion sensitive switch, and a sequencer.

12. The glove as recited in claim 9, wherein said at least one light source comprises an LED.

13. The glove as recited in claim 12, wherein said at least one light source comprises an LED of a single color.

14. The glove as recited in claim 12, wherein said at least one light source comprises an LED of at least two colors.

15. The glove as recited in claim 10, further comprising:

f) at least one bell attached to at least one of said finger regions and said thumb region proximate said distal end.

* * * * *